United States Patent [19]

Pitts

[11] 4,415,946

[45] Nov. 15, 1983

[54] ANTISTATIC CHAIRMAT

[75] Inventor: Warren R. Pitts, Needham, Mass.

[73] Assignee: Dennison Manufacturing Company, Framingham, Mass.

[21] Appl. No.: 346,716

[22] Filed: Feb. 8, 1982

[51] Int. Cl.[3] ..... H05F 3/00

[52] U.S. Cl. ..... 361/212; 361/216

[58] Field of Search ..... 361/212, 216, 220

[56] References Cited

U.S. PATENT DOCUMENTS

| | | | |
|---|---|---|---|
| 2,302,003 | 11/1942 | Cadwell et al. | 361/212 X |
| 2,323,461 | 7/1943 | Donelson | 361/216 |
| 2,378,623 | 6/1945 | Donelson et al. | 361/216 |
| 2,416,202 | 2/1947 | Naumann | 361/212 |
| 3,132,065 | 5/1964 | Barsy et al. | 361/220 X |
| 4,208,696 | 6/1980 | Lindsay et al. | 361/212 |
| 4,301,040 | 11/1981 | Berbeco | 361/212 X |

*Primary Examiner*—Harry E. Moose, Jr.
*Attorney, Agent, or Firm*—Arthur B. Moore

[57] ABSTRACT

An antistatic chairmat for preventing electrical shocks due to triboelectricity. The chairmat consists of a transparent plastic material and includes an array of semiconductive inserts with a ground connection. The preferred design incorporates a conductive or semiconductive lower layer, and an insulative intermediate layer which may be a printed design, or sheet. The lower conductive or semiconductive layer provides electrical continuity to ground via studs at the bottom of the semiconductive inserts. An alternative antistatic chairmat includes a plurality of semiconductive layers bridged by one or more conductive grounding clips.

21 Claims, 6 Drawing Figures

ANTISTATIC CHAIRMAT

BACKGROUND OF THE INVENTION

The present invention relates to chairmats having antistatic properties, and most especially to antistatic chairmats of a transparent appearance.

One well known problem in office environments is the risk of shock to office workers due to triboelectricity. This is especially prevalent in offices with large electronic machinery and the like. It is known to provide floor mats and chairmats having a grounding connection to allow charge dissipation. Such chairmats typically consist of a plastic material in which a matrix of carbon particles or other material is dispersed resulting in a semiconductive composite. This prior art design suffers the disadvantages of an unattractive appearance and a limited discharge rate through a single ground connection.

Accordingly it is a primary object of the invention to design a chairmat which combines antistatic characteristics with a pleasing appearance. A particular object of the invention is to provide antistatic chairmats of transparent appearance.

Another object of the invention is to achieve rapid discharge rates in such antistatic chairmats. As a related object, it is desirable to maintain this characteristic under varying relative humidities.

SUMMARY OF THE INVENTION

In fulfilling the above and related objects, the invention provides an antistatic chairmat consisting of a clear plastic material with an array of semiconductive inserts, and a grounding connection to each of the inserts. In the preferred embodiment, the chairmat comprises a composite structure with a conductive or semiconductive layer to provide a path to ground.

In accordance with one aspect of the invention, the semiconductive inserts comprise plugs with semiconductive studs at the bottom. The semiconductive stud may be an extended stud for carpets, or a shallow member of a high friction material, for bare floors.

In accordance with another aspect of the invention the chairmat may include at the bottom a conductive or semiconductive panel containing punched holes matching those through the body of the chairmat. Alternatively, the bottom layer may comprise a printed conductive design similar to that found in printed circuit boards. The upper surface of each of the studs contacts the conductive or semiconductive layer in order to provide electrical continuity to ground. Alternatively, the semiconductive inserts are grounded through an array of elongate conductors housed in channels in the bottom panel.

In accordance with a preferred embodiment of the invention, the chairmat further includes an intermediate insulative layer. The intermediate layer may comprise a printed design or solid colored layer of a decorative appearance.

In a particular embodiment of the invention, the semiconductive bottom layer comprises a polypropylene sheet between 1/32 and 1/16 of an inch in thickness, which contains a carbon matrix or the like. The top surface of this sheet has an adhesive coating that may bind a conductive material. This semiconductive layer may be laminated to the body of a chairmat of the type described above, or may be added by the user to a conventional nonconductive chairmat to provide a semiconductive composite.

An alternative design for a transparent antistatic chairmat includes a plurality of semiconductive layers bridged by one or more grounding clips. In the preferred version of this embodiment, the semiconductive layers comprise polyvinyl chloride with an antistatic agent and plasticizer added in appropriate portions. This composite may further include a conductive or semiconductive base layer of a decorative appearance.

BRIEF DESCRIPTION OF THE DRAWINGS

The above and additional aspects of the invention are illustrated with reference to the detailed description which follows, taken in conjunction with the drawings in which.

DETAILED DESCRIPTION

Reference should now be had to FIGS. 1 through 6 for a detailed description of the preferred embodiments. As seen in the plan view of FIG. 1, an advantageous design of antistatic chairmat 10 includes a transparent body 11 of desired configuration, containing an array of semiconductive inserts 12. Chairmat body 11 comprises a transparent plastic material such as polyvinyl chloride, haing dielectric characteristics. Inserts 12 are a plurality of plastic members each including, for example, carbon powder in dispersion. As further described below, an electrical connection to ground for each of inserts 12 allows discharge through any of the inserts 12 to ground, thereby achieving rapid discharge rates, even at low relative humidities. The grounding path includes a current limiting resistor R.

Figure 2:
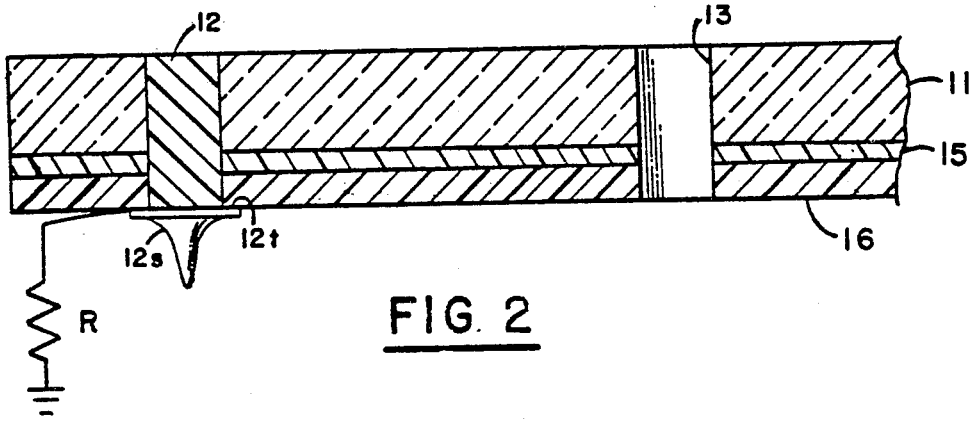
FIG. 2 is a sectional view of a preferred composite structure for the chairmat of FIG. 1.

With reference to the sectional view of FIG. 2, a preferred composition of chairmat 10 includes in addition to the transparent top layer 11 an intermediate insulative layer 15 and conductive or semiconductive base layer 16. Apertures 13 through each of these layers permit the insertion of plugs 12, each of which include at its base a stud 12*s*. Stud 12*s* may consist of an extended member suitable for engaging a carpet, or alternatively may have a flatter profile and a high coefficient of friction if the chairmat is to be placed on a bare floor (see FIG. 3). The inserts 12 may be retained within apertures 13 by press fitting, adhesive, screw threads, or other suitable means. Inserts 12 are desirably arranged in an array of 2–5 inch intervals, most preferably around 4 inch intervals.

An electrical path to ground is achieved for each of the inserts 12 by means of the interface between the top surface 12*t* of stud 12*s* and the conductive or semiconductive base layer 16. Base layer 16 may comprise a conventional semiconductive material such as polypropylene or polyvinyl chloride with a dispersed carbon matrix, or alternatively may comprise a conductive layer such as a printed metallic pattern or foil. The intermediate layer 15 advantageously consists of a decorative printed design of nonconductive ink. Alternatively, layer 15 may be an insulating sheet of printed material.

Figure 3:
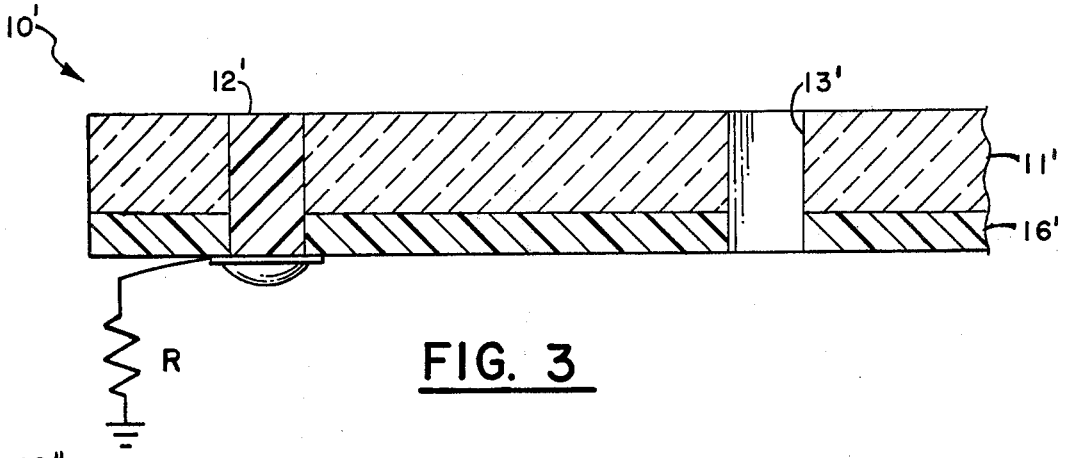
FIG. 3 is a sectional view of an alternative composite structure for the chairmat of FIG. 1.

In an alternative embodiment of the invention shown in section in FIG. 3, the chairmat composite 10' includes in addition to body 11' a printed semiconductive ink layer 16' with no intermediate layer. The printed layer will undergo minimal wear as it is not exposed to scuffing, etc.

Figure 4:
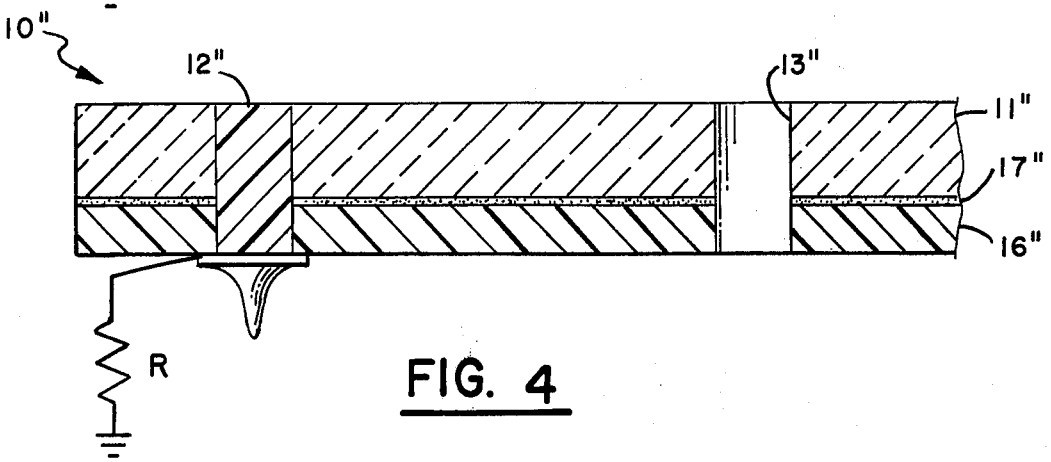
FIG. 4 is a sectional view of yet another composite structure for the chairmat of FIG. 1.

Alternatively, as illustrated in FIG. 4, the bottom layer 16'' of chairmat 10'' consists of a polypropylene panel approximately 1/32" to 1/16" in thickness, coated at its upper surface with an adhesive 17''. Adhesive layer 17'' binds a matrix of carbon powder, aluminum flakes, or other conductive particles. These laminates could be fabricated in tile or strip form with a backing sheet (not shown) over the adhesive layer 17''. The backing sheet would be removed by the user to attach the laminate to a conventional nonconductive chairmat.

Figure 5:
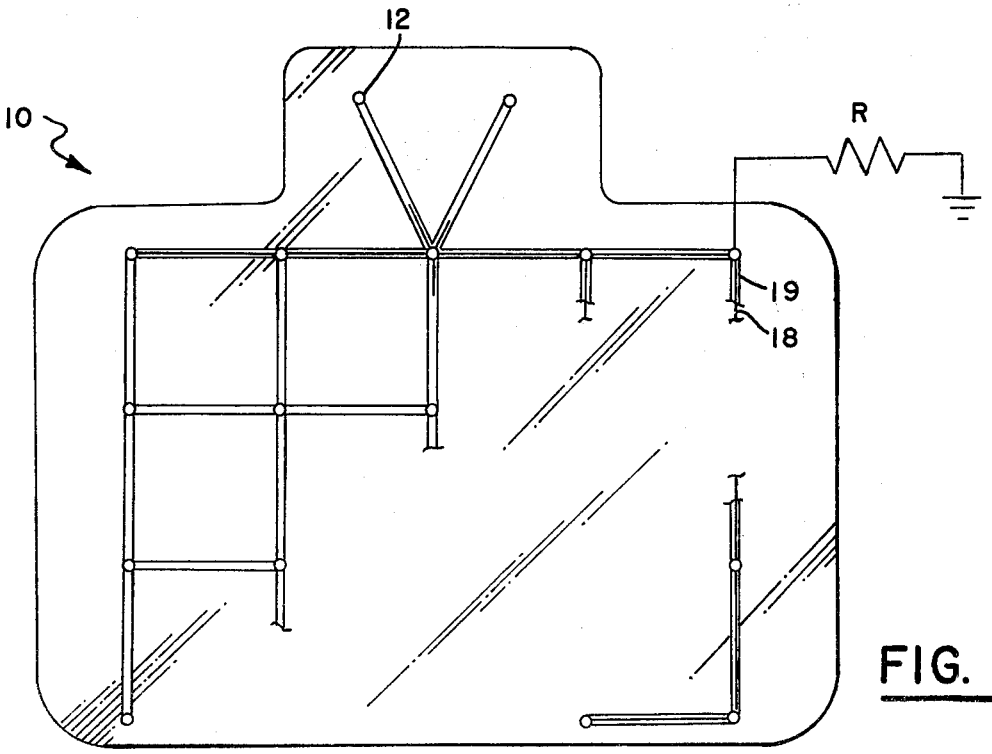
FIG. 5 is a bottom plan view of an antistatic chairmat in accordance with an alternative embodiment of the invention.

Yet another embodiment of the invention is illustrated in the bottom plan view of FIG. 5. The bottom face of chairmat 10 includes grooves 18 interconnecting the various inserts 12. Grooves 18 house wires 19 which provide conductive interconnections to ground.

Figure 6:
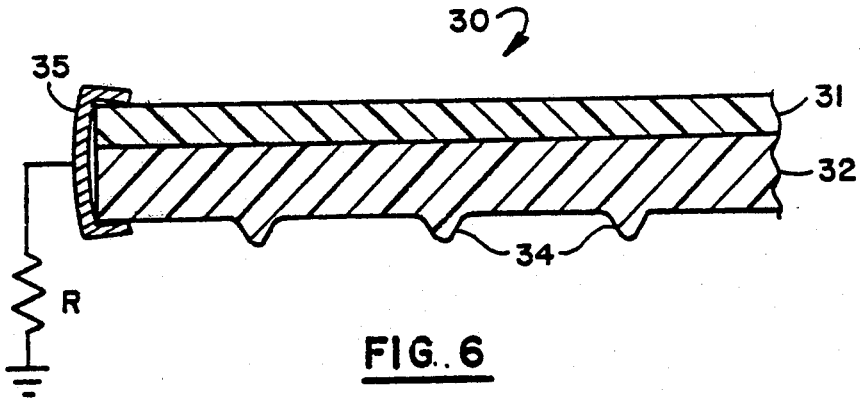
FIG. 6 is a sectional view of an antistatic chairmat in accordance with a further embodiment of the invention.

FIG. 6 shows in section an alternative antistatic floor mat design 30, which does not incorporate semiconductive inserts. Chairmat 30 comprises semiconductive transparent layers 31, 32; additional layers may be included. The bottom layer 32 is profiled in studs or other suitable base members 34. A preferred composition of each layer consists of polyvinyl chloride with a dispersed antistatic material and plasticizer. The latter component is added to provide an appropriate flexibility, and lubricity for the top layer 31. The formulation advantageously further includes a stabilizer to prevent yellowing at higher temperatures. Floor mat 30 has at its edges one or more conductive brackets 35, each of which unites semiconductive layers 31 and 32, and is connected to ground. The bottom transparent layer 32 may be replaced with a conductive or semiconductive decorative layer (not shown—cf. layer 16, FIG. 1).

The invention is further illustrated in the following nonlimiting examples.

EXAMPLE 1

Figure 1:
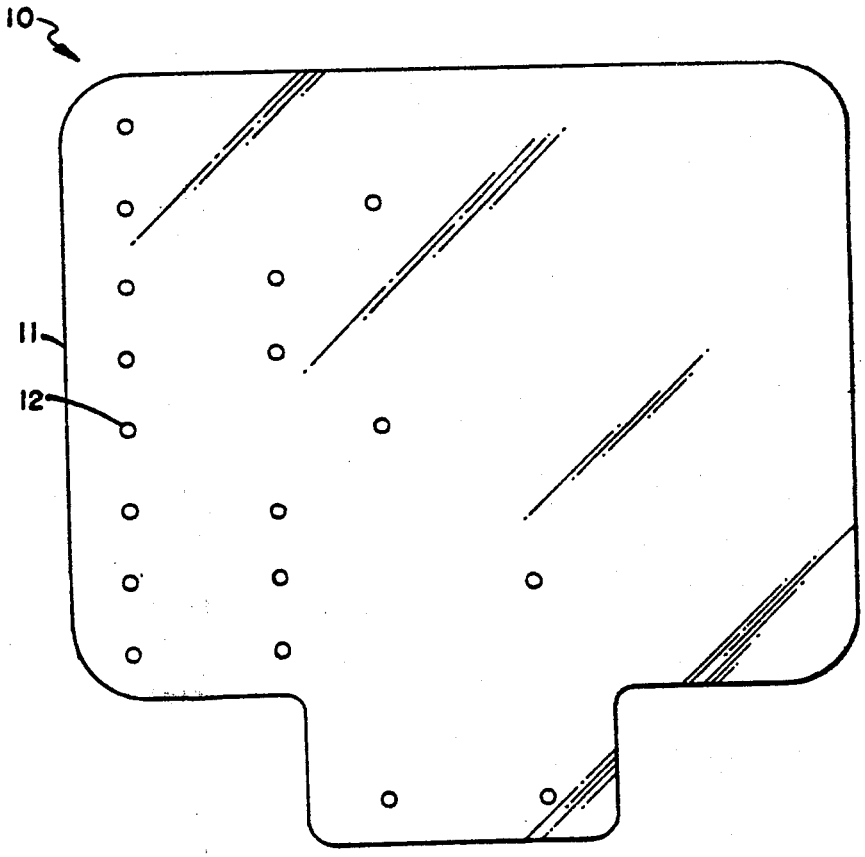
FIG. 1 is a top plan view of an antistatic chairmat in accordance with the preferred embodiment.

An antistatic chairmat 10 of the type illustrated in FIGS. 1 and 2 included a ⅛" thick layer 11 of clear polypropylene approximately 6 mm thick through which was drilled a rectangular array of cylindrical apertures. The undersurface of layer 11 was imprinted with a 2 mil decorative pattern of nonconductive inks. A 1/32" thick layer 16 of polypropylene impregnated with 20 percent carbon was laminated thereto at the bottom face. Layer 16 included holes matching those through layer 11. Plugs 12 were press fit into the chairmat apertures, with extended studs 12*s* flush against the bottom of layer 16. A grounding connection was provided to layer 16 at one corner.

A charged object of 300 picofarads was employed in this and the following examples for a quantitative test of discharge rates. The chairmat of Example 1 achieved a reduction from approximately 5 KV to 500 volts in 1 second.

EXAMPLE 2

A chairmat was fabricated in accordance with FIG. 3, by overprinting the ⅛" thick polypropylene layer 11' of example 1 with a 2 mil thick screen printed semiconductive ink 16' including carbon black additive. Ink layer 16' was printed in a rectilinear pattern. Inserts 12' consisted of flat-headed members fabricated of polypropylene with a dispersed 20 percent carbon matrix.

The chairmat of Example 2 exhibited comparable discharge characteristics to those of Example 1.

EXAMPLE 3

A laminate was fabricated including layers 16'' and 17'' of FIG. 4. Layer 16'' consisted of a 1/16" thick sheet of polypropylene, and adhesive layer 17'' consisted of epoxy adhesive which was coated onto the polypropylene sheet. Adhesive layer 17'' was then sprinkled with finely divided carbon powder.

EXAMPLE 4

A floor mat 30 such as shown in FIG. 6 comprised heat-laminated 5 mm thick layers 31, 32 of the formulation shown in Table 1, in which all parts are by weight. The antistatic agent and plasticizer were mixed into a polyvinyl chloride paste, and the mixture extruded in sheet form. Layers 31 and 32 were bracketed by several stainless steel clips 35, each connected to ground through a current limiting resistor.

TABLE 1

| | Top Layer | Bottom Layer |
|---|---|---|
| Polyvinyl chloride | 100 parts | 100 parts |
| Hostastat HS-1* | 1.5 parts | 1.5 parts |
| Plasticizer | | |
| (di-2-ethyl hexyl phthalate) | 60 parts | 40 parts |
| Stabilizer | | |
| BA Cd Zn | 2.5 parts | 2.5 parts |
| Stearic Acid | 0.7 parts | 0.7 parts |
| Epoxy Soya | 2.5 parts | 2.5 parts |

*Hostastat HS-1 is a trademark of the American Hoechst Corp. of 1041 Rt. 201-206 N. Somerville, N.J. 08876 for an anionic aliphatic sulphonate.

While various aspects of the invention have been set forth by the drawings and the specification, it is to be understood that the foregoing detailed description is for illustration only and that various changes in parts, as well as the substitution of equivalent constituents for those shown and described, may be made without departing from the spirit and scope of the invention as set forth in the appended claims.

I claim:

1. A charge dissipating floormat comprising:

a dielectric panel comprised of a transparent polymeric material, containing a plurality of channels between upper and lower surfaces;

a semiconductive base layer at the lower surface of said dielectric panel containing a plurality of channels corresponding to the channels in said dielectric panel;

a plurality of inserts fitted within the channels in said dielectric panel and semiconductive base layer, said inserts being comprised of a material selected from the group electrically conductive and semiconductive materials; and an electric ground for said inserts.

2. A charge dissipating floor mat as defined in claim 1, wherein each of said inserts comprises a plug fitted within one of said channels, and a base member for supporting said floor mat.

3. A charge dissipating floor mat as defined in claim 1 further comprising a current limiting resistor in connection with said electrical ground.

4. A charge dissipating floormat as defined in claim 1 wherein said dielectric panel and said semiconductive base layer are each comprised of a material selected from the group consisting of polyvinylchloride and polypropylene.

5. A charge dissipating floor mat as defined in claim 1 wherein a lower surface of said floor mat contains a plurality of grooves interconnecting the channels, and wherein said inserts are grounded through elongate conductors within said grooves.

6. A charge dissipating floor mat as defined in claim 1 where said semiconductive base layer comprises a polypropylene panel, coated on its upper face with an adhesive material.

7. A charge dissipating floor mat as defined in claim 1 wherein said adhesive material binds particles in the class consisting of carbon powder and aluminum flakes.

8. A charge dissipating floor mat as defined in claim 1 further comprising an electrically insulating layer intermediate said semiconductive base layer and said dielectric panel.

9. A charge dissipating floor mat as defined in claim 8 wherein the electrically insulating layer comprises a decorative pattern of electrically insulating ink.

10. A charge dissipating floor mat as defined in claim 1 wherein said inserts are spaced at intervals of between 2 to 5 inches.

11. A charge dissipating floor mat as defined in claim 10 wherein said inserts are spaced at intervals of around 4 inches.

12. A charge dissipating floormat comprising a plurality of semiconductive transparent panels forming a lamination, said panels being electrically interconnected to ground on at least one edge by at least one electrically conductive member extending between top and bottom surfaces of said floormat.

13. A charge dissipating floormat as defined in claim 12, wherein said semiconductor panels are each comprised of a film-forming polymeric material containing a dispersion of a transparent antistatic agent.

14. A charge dissipating floor mat as defined in claim 13 wherein said semiconductive panel is comprised of polyvinyl chloride with a dispersed transparent antistatic agent and plasticizer.

15. A charge dissipating floor mat as defined in claim 13 wherein the antistatic agent comprises an anionic aliphatic sulphonate.

16. A charge dissipating floormat as defined in claim 13 wherein said semiconductive panels further comprise a plasticizer.

17. A charge dissipating floor mat as defined in claim 12 further including a stabilizer.

18. A charge dissipating floor mat as defined in claim 12 further comprising a base panel of conductive or semiconductive printed material.

19. A charge dissipating floormat as defined in claim 12, wherein the bottom surface of said floormat is formed in a plurality of base members for supporting said floormat.

20. A charge dissipating floormat as defined in claim 12, further comprising a pattern of a material selected from the group consisting of semiconductive and conductive inks imprinted on at least one of the top and bottom surfaces of said floormat, said pattern being connected to the electrically conductive member.

21. A charge dissipating floormat as defined in claim 20 wherein the material comprises a semiconductive ink containing a dispersion of carbon black particles.

* * * * *